US011808103B2

(12) United States Patent
Alders et al.

(10) Patent No.: US 11,808,103 B2
(45) Date of Patent: Nov. 7, 2023

(54) SWELLABLE PACKER ASSEMBLY FOR A WELLBORE SYSTEM

(71) Applicant: TIER 1 ENERGY TECH, INC., Edmonton (CA)

(72) Inventors: Ronald Scott Alders, Cold Lake (CA); Jeffrey Golinowski, Sherwood Park (CA); Daniel P Lupien, Edmonton (CA)

( * ) Notice: Subject to any disclaimer, the term of this patent is extended or adjusted under 35 U.S.C. 154(b) by 103 days.

(21) Appl. No.: 17/160,970

(22) Filed: Jan. 28, 2021

(65) Prior Publication Data

US 2021/0230962 A1 Jul. 29, 2021

Related U.S. Application Data

(60) Provisional application No. 62/967,336, filed on Jan. 29, 2020.

(30) Foreign Application Priority Data

Oct. 26, 2020 (CA) ..... 3094787

(51) Int. Cl.
*E21B 33/12* (2006.01)
*E21B 23/06* (2006.01)
*E21B 43/24* (2006.01)

(52) U.S. Cl.
CPC ..... *E21B 33/1208* (2013.01); *E21B 23/06* (2013.01); *E21B 43/2406* (2013.01)

(58) Field of Classification Search
CPC ... E21B 33/1208; E21B 23/06; E21B 43/2406
See application file for complete search history.

(56) References Cited

U.S. PATENT DOCUMENTS

2010/0044028 A1* 2/2010 Brooks ..... E21B 23/06 166/179
2015/0211323 A1* 7/2015 Atkins ..... E21B 23/06 166/387
2016/0177659 A1* 6/2016 Voll ..... E21B 33/1208 166/387

* cited by examiner

*Primary Examiner* — Crystal J. Lee
(74) *Attorney, Agent, or Firm* — Bennett Jones LLP

(57) ABSTRACT

A swellable packer assembly includes a mandrel, a base pipe disposed within the mandrel, a swellable seal element retained externally on the mandrel, and a shearable member that releasably secures the base pipe to the mandrel. In use, the base pipe forms part of a downhole tubing string in a wellbore. The seal element is swelled with a swelling fluid to seal between an outer wall of the mandrel and a wellbore wall. The shearable member is allowed to shear so that the injection tubing string including the base pipe may move axially within to the wellbore, while the seal element and the mandrel remain stationary relative to wellbore, with the seal element in contact with the wellbore wall. The assembly may help to avoid distortion of and damage to the seal element that may otherwise occur due to thermal expansion and contraction of the downhole tubing string.

9 Claims, 4 Drawing Sheets

SWELLABLE PACKER ASSEMBLY FOR A WELLBORE SYSTEM

CROSS-REFERENCE TO RELATED APPLICATION

The present application claims the priority benefit of U.S. Provisional Patent Application No. 62/967,336, filed on Jan. 29, 2020, and Canadian Application No. 3,094,787, filed on Oct. 26, 2020, the entire contents of each which are incorporated herein by reference.

FIELD OF THE INVENTION

The present invention relates to a swellable packer assembly for a wellbore system, such as a wellbore system used to recover oil and gas, or geothermal energy.

BACKGROUND OF THE INVENTION

A conventional wellbore system includes a downhole tubing string that extends into a wellbore drilled into a subterranean formation. The wellbore wall may be defined by the formation itself, or a tubular casing or liner that lines the formation.

A packer may be used to seal the annular space between the tubing string and the wellbore wall, and thereby isolate a zone of the wellbore. A conventional swellable packer assembly includes an annular seal element attached to a base pipe, which is used to form part of the tubing string. The seal element is made of an elastomeric material that absorbs a fluid (e.g., a water-based, an oil-based fluid, or a gas) in the wellbore to increase in volume, and thereby occupy the annular space, and expand into contact with the wellbore wall.

The tubing string may undergo thermal expansion and contraction in the axial direction of the wellbore. This tends to move the seal element axially relative to the wellbore because the seal element is attached to the base pipe that forms part of the tubing string. Such movement, however, is opposed by friction between the swelled seal element and the wellbore wall. As a consequence, the seal element is subjected to the stresses that may distort and damage the seal element, and compromise the integrity of the seal.

SUMMARY OF THE INVENTION

The present invention relates to a swellable packer assembly for use with a wellbore system containing a downhole tubing string. The present invention may help to avoid distortion of and damage to a swellable seal element that may otherwise occur due to thermal expansion and contraction of the downhole tubing string. Non-limiting applications include wellbore systems used to recover oil and gas, which are subjected to steam-assisted gravity draining (SAGD), cyclic steam stimulation (CC S), or hot oiling operations, and wellbore systems used to recover geothermal energy.

In one aspect, the present invention comprises a swellable packer assembly for use with a wellbore containing a downhole tubing string. The swellable packer assembly includes a tubular mandrel, a tubular base pipe, an annular swellable seal element, and at least one shearable member. The mandrel defines an axially extending mandrel bore. The base pipe is for forming part of the downhole tubing string, and is disposed within the mandrel bore. The seal element is for sealing between an outer wall of the mandrel and a wall of the wellbore, and is retained externally on the mandrel. The at least one shearable member releasably secures the base pipe to the mandrel, and is shearable by opposing axial shear forces applied by the base pipe and the mandrel. The base pipe is moveable axially relative to the mandrel and the at least one seal element after the at least one shearable member is sheared. The at least one shearable member may include a shear pin extending through an aperture defined by the mandrel and into a recess defined by the base pipe.

In one embodiment of the swellable packer assembly, the swellable packer assembly may also include at least one O-ring seal for preventing fluid communication between an inner wall of the mandrel and an outer wall of base pipe. The at least one O-ring seal is disposed within the mandrel bore, and encircles the outer wall of the base pipe. The at least one O-ring seal may be retained within at least one annular groove defined by the inner wall of the mandrel.

In one embodiment of the swellable packer assembly, the swellable packer assembly may also include at least one scraper ring for scraping an outer wall of the base pipe when the base pipe moves axially relative to the mandrel. The at least one scraper ring is disposed within the mandrel bore, and encircles the outer wall of the base pipe. The at least one scraper ring may be retained within at least one annular groove defined by an inner wall of the mandrel. In embodiments where the swellable packer assembly includes at least one O-ring seal (as described above), the O-ring seal may be disposed axially between a pair of such scraper rings.

In another aspect, the present invention comprises a method for assembling a swellable packer assembly. The method includes the steps of: (a) attaching an annular swellable seal element externally to a tubular mandrel defining an axially extending mandrel bore; (b) disposing a base pipe within the mandrel bore; and (c) when the base pipe is disposed within the mandrel bore, releasably securing the base pipe to the mandrel with a shearable member that is shearable by opposing axial shear forces applied by the base pipe and the mandrel, such that the base pipe is moveable axially relative to the mandrel and the seal element after the shearable member is sheared. In embodiments of the method, the swellable packer assembly may be assembled to include features of the shear pin, the O-ring seal(s) and the scraper ring(s), as described above.

In another aspect, the present invention comprises a wellbore system. The wellbore system includes a wellbore containing a downhole tubing string, and any embodiment of a swellable packer assembly as described above, wherein the base pipe of the swellable packer assembly forms part of the downhole tubing string. In one embodiment of the wellbore system, the downhole tubing string comprises an injection tubing string for injecting steam into the wellbore.

In another aspect, the present invention comprises a method of operating a wellbore system comprising a wellbore containing a downhole tubing string. The method includes the steps of: (a) including any embodiment of a swellable packer assembly as described above in the downhole tubing string, wherein the base pipe of the swellable packer assembly forms part of the downhole tubing string; (b) contacting the annular seal element of the swellable packer assembly with a swelling fluid, such that the seal element increases in volume to seal between the outer wall of the mandrel of the swellable packer assembly and a wall of the wellbore; (c) allowing the at least one shearable member of the swellable packer assembly to shear due to opposing axial shear forces applied by the base pipe and the mandrel to the at least one shearable member; and (d) after the at least one shearable member is sheared, allowing axial movement of the downhole tubing string including the base pipe relative to the wellbore, while the seal element and the mandrel remain stationary relative to wellbore, with the seal element in contact with the wall of the wellbore. In one embodiment of the method, thermal expansion or contraction of the downhole tubing string, opposed by friction between the seal element and the wall of the wellbore, induces the opposing axial shear forces. In one embodiment of the method, thermal expansion or contraction of the downhole tubing string induces the axial movement of the downhole tubing string including the base pipe relative to the wellbore. In one embodiment of the method, the downhole tubing string comprises an injection tubing string for injecting steam into the wellbore.

BRIEF DESCRIPTION OF THE DRAWINGS

In the drawings, like elements may be assigned like reference numerals. The drawings are not necessarily to scale, with the emphasis instead placed upon the principles of the present invention. Additionally, each of the embodiments depicted are but one of a number of possible arrangements utilizing the fundamental concepts of the present invention.

DETAILED DESCRIPTION OF EMBODIMENTS OF THE INVENTION

Definitions

Figure 1:
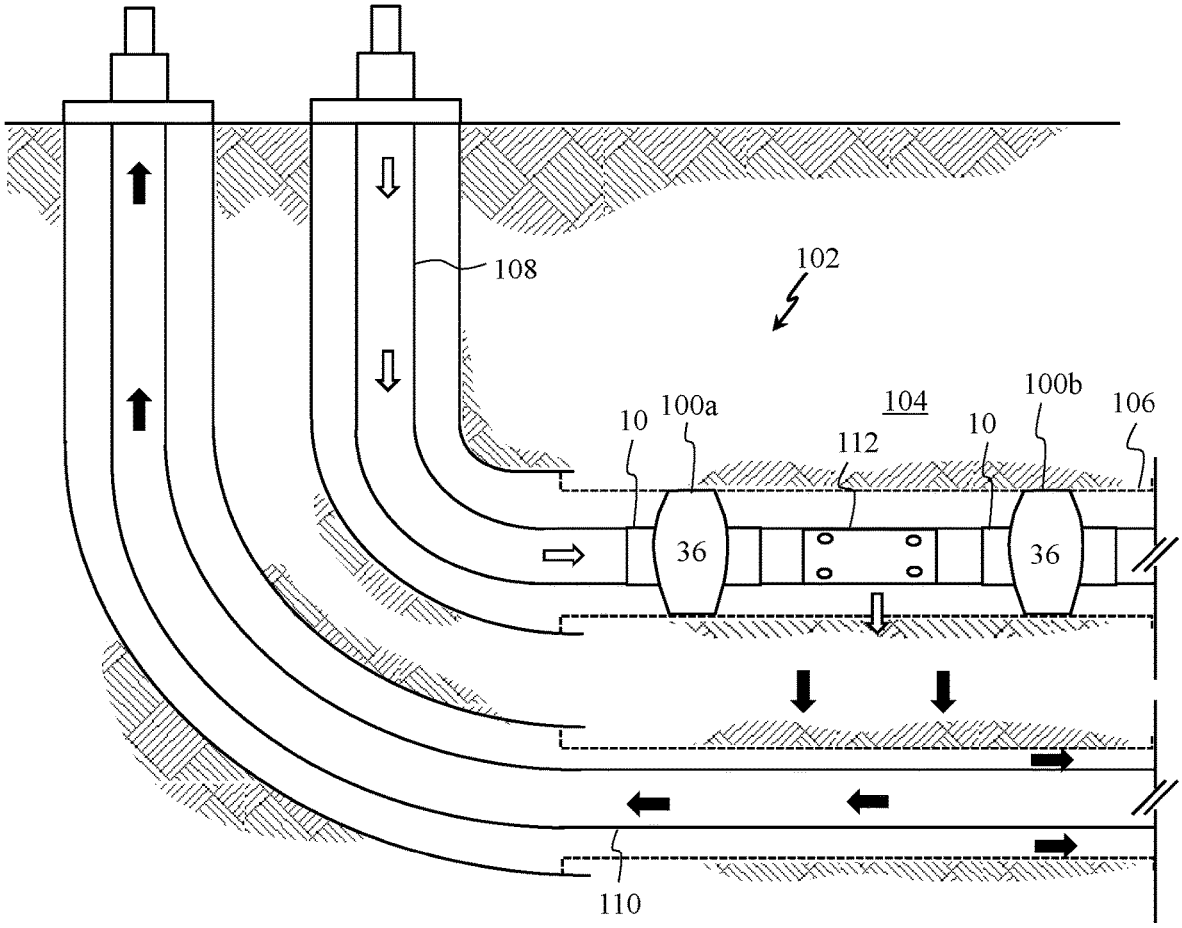
FIG. 1 shows a SAGD system including a pair of swellable packer assemblies of the present invention.

The present invention relates to a swellable packer assembly for a wellbore system, such as a wellbore system used to recover oil and gas, or geothermal energy. Any term or expression not expressly defined herein shall have its commonly accepted definition understood by a person skilled in the art.

The terms "wellbore wall" and "wall of a wellbore" describe a surface defining a wellbore. As non-limiting examples, a wellbore wall may be a subterranean formation that defines an uncased or unlined wellbore, or an inner wall of a tubular casing or liner inserted into a subterranean formation that defines a cased wellbore.

The term "swellable seal element" describes a seal element comprising a material that absorbs a swelling fluid when contacted with the swelling fluid such that the part increases in volume. As non-limiting examples, swellable materials include elastomers that absorb swelling fluids which include water-based liquids, hydrocarbon-based liquids, or gases. Swellable materials and swelling fluids are known to persons skilled in the part of swellable packers, and do not by themselves constitute the present invention.

In some alternative embodiments, the seal element may be deformable, meaning that the seal element is changeable in shape due to an actuating influence, in order to engage a wall of a wellbore. As a non-limiting example, the deformable seal element may deform due to the actuating influence of a force imparted by a mechanical or hydraulically operated mechanism.

The term "axial" describes the direction coinciding with the central longitudinal axis of a wellbore, a tubing string, or the apparatus (100) of the present invention, or part thereof, as the case may be. For example, in FIG. 1, the axial direction of the horizontal legs of the wellbores coincide with the horizontal direction of the drawing plane; and in FIG. 2, the axial direction of the apparatus (100) coincides with the vertical direction of the drawing plane.

The term "transverse" describes a direction perpendicular to the axial direction. For example, in FIG. 1, transverse directions of the horizontal legs of the wellbores include the vertical direction of the drawing plane, and the direction perpendicular to the drawing plane; and in FIG. 2, transverse directions of the apparatus (100) include the horizontal direction of the drawing plane, and the direction perpendicular to the drawing plane.

The terms "upper" and "lower", and like terms, describe relatively axially uphole and downhole parts, without limiting their elevation in use. For example, in FIG. 1, swellable packer assemblies (100*a*, 100*b*) may be described as an upper assembly and a lower assembly, respectively, even though situated at substantially the same elevation; and in FIG. 2, parts (14*a*, 14*b*) may be described as an upper end and a lower end, respectively, of a base pipe (10) even though they are situated at substantially the same elevation when the apparatus (100) is included in the horizontal leg of injection tubing string (108) shown in FIG. 1.

Exemplary Use of Swellable Packer Assembly.

In general, the swellable packer assembly (100) of the present invention may be used to seal an annular space between a downhole tubing string and a wellbore wall. In particular, the swellable packer assembly (100) may be useful in applications where significant thermal expansion and contraction of the tubing string is expected. Non-limiting applications include wellbore systems used to recover oil and gas, which are subjected to steam-assisted gravity draining (SAGD), cyclic steam stimulation (CSS), or hot oiling operations, and wellbore systems used to recover geothermal energy.

As an example, FIG. 1 shows the exemplary use of upper and lower swellable packer assemblies (100*a*, 100*b*) of the present invention in a SAGD system (102) within a subterranean hydrocarbon-bearing formation (104). The injection wellbore is defined in part by a perforated injection well liner (106), and contains an injection tubing string (108) for injecting steam into the formation (104). The injection tubing string (108) is made up of jointed tubing, including the base pipes (10) (as described below) of the assemblies (100*a*, 100*b*). The production wellbore contains the production tubing string (110). The horizontal leg of the injection wellbore is above and substantially parallel to the horizontal leg of the production wellbore.

In use, a swelling fluid is pumped into the injection wellbore to contact the swellable seal elements (36) (as described below) of the assemblies (100*a*, 100*b*). This causes the seal elements (36) to increase in volume, and seal against the wellbore wall defined by the perforated injection well liner (106). A steam generator (not shown) injects steam (denoted by the white arrows) into the injection tubing string (108). The injected steam exits the injection tubing string (108) via steam diverter apparatus (112) into the surrounding formation (104), thereby heating and reducing the viscosity of in situ hydrocarbons. The assemblies (100*a*, 100*b*) help to limit the injected steam to a desired zone of the formation (104). The reduced-viscosity hydrocarbons and condensed steam (denoted by the black arrows) flow downwards in the formation (104) into the production wellbore and into the production tubing string (110). This fluid is pumped through the production tubing string (110) to the surface. The response of the assemblies (100*a*, 100*b*) to thermal expansion or contraction of the injection tubing string (108) is further described below after describing the assembly (100) in greater detail.

Swellable Packer Assembly.

Figure 2:
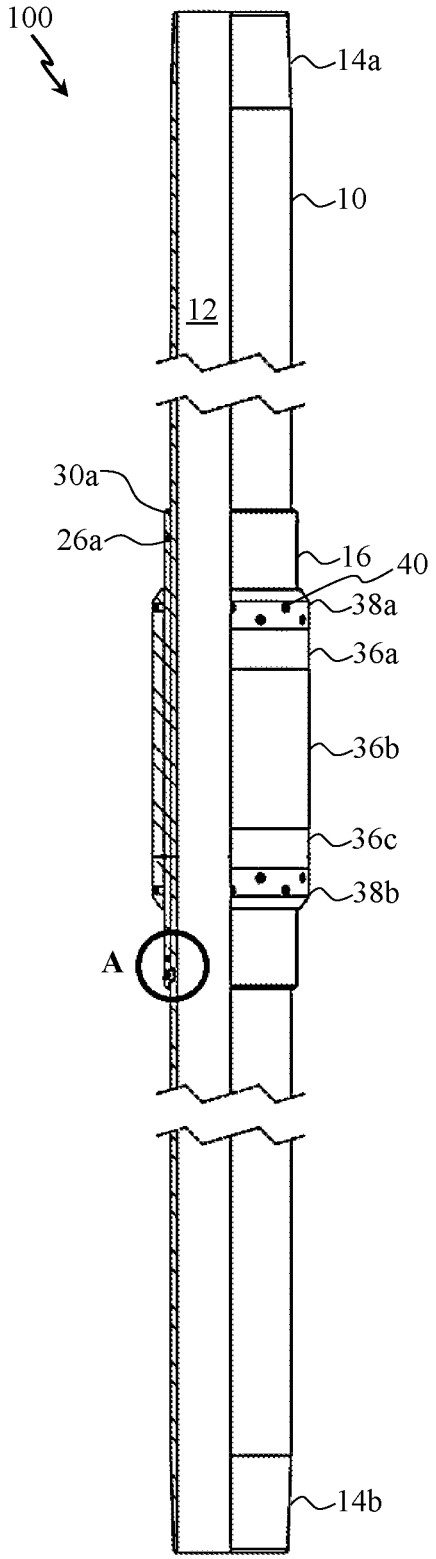
FIG. 2 shows an axial quarter-sectional view of an embodiment of a swellable packer assembly of the present invention.
Figure 3:
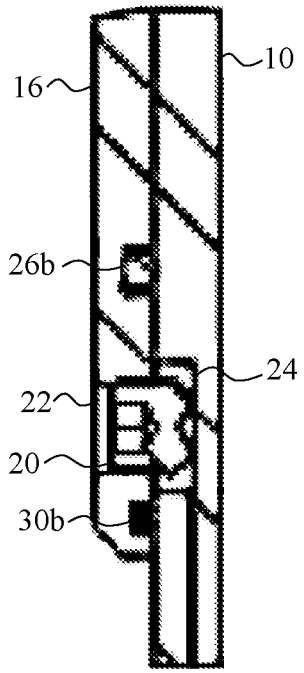
FIG. 3 shows region "A" of FIG. 2, at an enlarged scale relative to FIG. 2.
Figure 4:
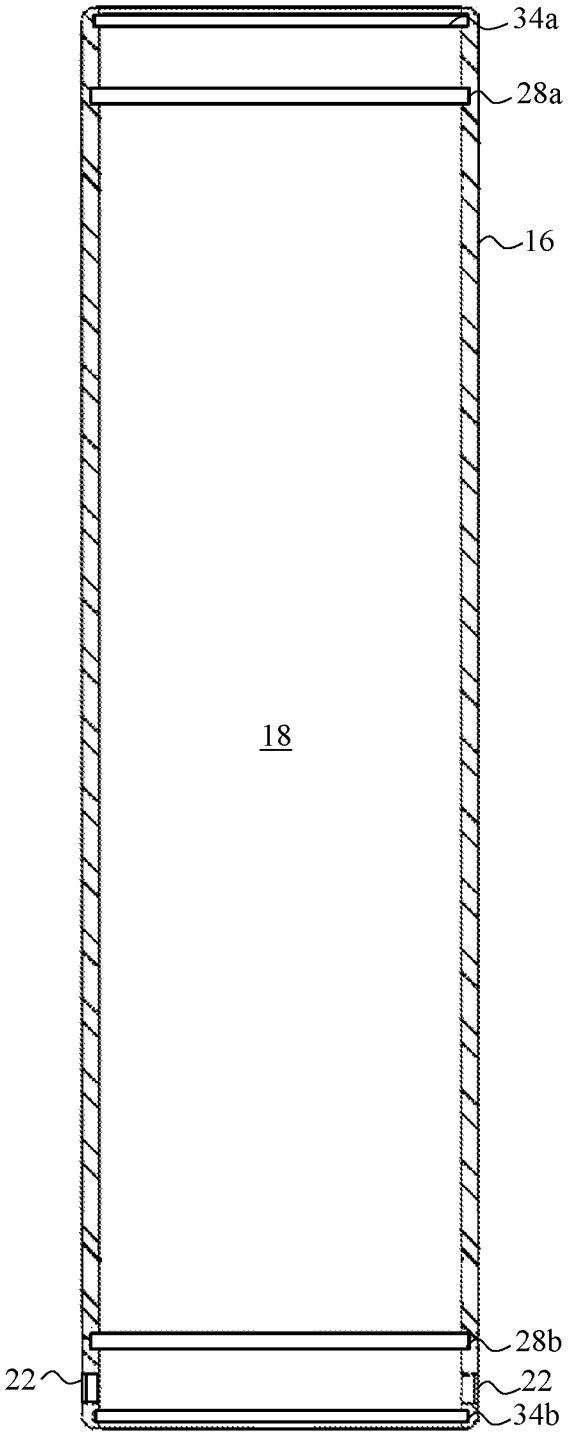
FIG. 4 shows an axial half-sectional view of an embodiment of a mandrel, O-ring seals, and scraper rings of the swellable packer assembly of FIG. 2, at an enlarged scale relative to FIG. 2.
Figure 5:
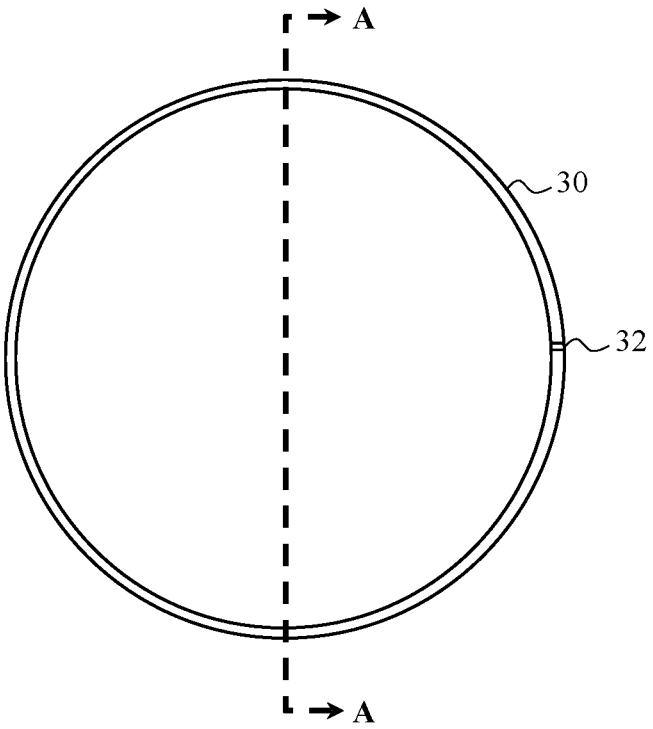
FIG. 5 shows a transverse end view of an embodiment of one of the scraper rings of the swellable packer assembly of FIG. 2.
Figure 6:
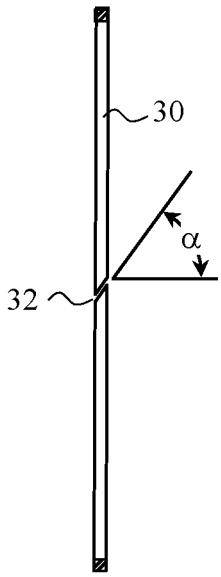
FIG. 6 shows an axial half-sectional view of the scraper ring of FIG. 5, along section line A-A of FIG. 5.

FIG. 2 shows one embodiment of a swellable packer assembly (100) of the present invention, which may be used in the system of FIG. 1. FIGS. 3 to 6 show parts of the swellable pack assembly (100). The apparatus (100) includes a base pipe (10), a mandrel (16), shearable members (20), upper and lower O-ring seals (26*a*, 26*b*), upper and lower scraper rings (30*a*, 30*b*), upper, intermediate, and lower annular swellable seal elements (36*a*, 36*b*, 36*c*), and upper and lower end rings (38*a*, 38*b*).

The base pipe (10) is a tubular member defining an axially extending base pipe bore (12) which forms part of the injection tubing string (108). The base pipe (10) may be a pup joint. While dimensions and physical attributes of the base pipe are not essential elements of the invention, an exemplary embodiment may have a unit linear weight of about 11.6 lbs/ft (17.3 kg/m), a tensile strength rating of about 255,440 lbs (1136 kN), and a collapse rating of about 6,940 psi (47,850 kPa). The base pipe (10) has an axial length of about 96 inches (2438 mm), and an outer diameter of about 4.5 inches (114 mm). The upper (14*a*) and lower end (14*b*) of the base pipe (10) are threaded pin ends for removable connection to uphole and downhole portions of the injection tubing string (108). As a non-limiting example, the base pipe (10) may be made of grade L80 steel (American Petroleum Institute, Specification 5CT) suitable for use in environments containing hydrogen sulfide. The base pipe (10) may be plated with a nickel alloy to enhance its corrosion, abrasion, and wear resistance. In other embodiments, the base pipe (10) may have different dimensions, be adapted with different means for connection to the tubing string, and be made of different suitable materials.

The mandrel (16) is a tubular member which fits around the exterior of the base pipe (10), preferably with close tolerance. In one specific embodiment, the mandrel (16) is made from pipe stock having a unit linear weight of about 32 lb/ft (47.62 kg/m). The mandrel (16) has a total length of about 18 inches (457 mm), an outer diameter of about 4.950 inches (125.7 mm), and an inner diameter of about 4.516 inches (114.7 mm). Accordingly, the outer wall of the base pipe (10) (having an outer diameter of about 4.5 inches (114 mm)) fits within close tolerance of the inner wall of the mandrel (16), while still being able to move axially relative to the mandrel (16). Shearable members (20) prevent such axial movement until sheared (as described below). As a non-limiting example, the mandrel (16) may be of grade 1026 carbon steel (American Iron and Steel Institute (AISI) standard). In other embodiments, the mandrel (16) may have different dimensions, be adapted with different means for connection to the tubing string, and be made of different materials.

The shearable members (20) releasably secure the base pipe (10) to the mandrel (16). They are configured to shear when opposing axial shear forces applied thereto by the base pipe (10) and the mandrel (16) exceed the shear strength of the shearable members (20). A person skilled in the art will be able to select parameters such as the material and geometric properties of the shearable members (20) so that they have a desired shear strength. The shear strength may be selected so that the shearable members (20) do not fail due to shear forces induced by handling and installation of the assembly (10) in the wellbore, but do fail due to greater shear forces induced by substantial thermal expansion or contraction of the injection tubing string (as described below). As a non-limiting example, the shearable members (20) may collectively have a shear strength of about 650 lbf (pound force) (2890 Newtons). In the embodiment shown in FIGS. 2 and 3, the apparatus has two shearable members (20), although only one of them is visible in the quarter-sectional view of FIG. 2. Each shearable member (20) is in the form of threaded metal shear pin, that is inserted through one of the apertures (22) defined by an internally threaded wall of the mandrel (16) (see FIG. 4), which is tapped with UNC size 3/8-16 coarse pitch threads (American National Standards Institute, Standard B1.1). The outer end of each shearable member (20) defines a recess for engagement by a hex key, or may be otherwise adapted for engagement by an internal or external drive tool. The inner end of each shearable member (20) is received within a spot faced recess (24) defined by the outer wall of the base pipe (10). In other embodiments, the apparatus (10) may have only one shearable member (20), or a greater number of shearable members (20). In other embodiments, the shearable members (20) may have forms other than a threaded shear pin, and may be retained by the mandrel (16) and/or base pipe (10) by means other than a threaded connection.

The O-ring seals (26*a*, 26*b*) prevent communication of fluid between the outer wall of the base pipe (10) and the inner wall of the mandrel (16). In the embodiment shown in the Figures, the O-ring seals (26*a*, 26*b*) are size #246 O-rings (Society of Automotive Engineers, standard AS568) having an outer diameter of about 4.75 inches (120.6 mm) and an inner diameter of about 4.5 inches (114 mm). In the embodiment shown in FIG. 4, the inner wall of the mandrel (16) defines upper and lower annular seal grooves (28*a*, 28*b*) having a diameter of about 4.740 inches (120.4 mm) that securely retain the upper and lower O-ring seals (26*a*, 26*b*), respectively. Accordingly, the O-ring seals (26*a*, 26*b*) create a fluid-tight seal between the outer wall of the base pipe (10) and the inner wall of the mandrel (16), while still permitting the base pipe (10) to move axially within the mandrel (16) after the shearable members (20) have failed. As a non-limiting example, the O-ring seals (26*a*, 26*b*) may be made of a steam and hydrocarbon-resistant elastomer, such as Thermanite™ (Rubberatkins Ltd., Aberdeen UK). The O-ring seals (26*a*, 26*b*) are preferably wear resistant, as they will be abraded by the outer wall of the base pipe (10) when it moves axially within the mandrel (16). In other embodiments, the assembly (100) may have only one O-ring seal (26), or a greater number of O-ring seals (26). In other embodiments, the O-rings (26) may have different dimensions, be secured to the mandrel (16) by different means, and may be made of different materials. In other embodiments, the outer surface of the base pipe (10) may instead define upper and lower grooves that securely retain the upper and lower O-ring seals (26*a*, 26*b*), so that the O-ring seals (26*a*, 26*b*) may move in unison with the base pipe (10).

The scraper rings (30*a*, 30*b*) protect the O-rings (20*a*, 20*b*) from debris flowing in the wellbore. The scraper rings (30*a*, 30*b*) may also scrape debris and scale (e.g., dissolved salt precipitates in oil and gas fluids) from the outer wall of the base pipe (10), when the base pipe (10) moves axially within the mandrel (16). In the embodiment shown in FIGS. 5 and 6, the scraper ring (30) has a scarf cut (32) with a width of about 0.030 inches (0.76 mm), and oriented at an angle, α, of about 60 degrees from the axial direction. The scarf cut (32) allows the scraper ring (30) to be compressed for installation within the bore (18) of the mandrel (16). The scraper rings (30*a*, 30*b*) have an axial length of about 0.090 inches (2.3 mm), an outer diameter of about 4.680 inches (118.9 mm), and an inner diameter of about 4.505 inches (114.4 mm). In the embodiment shown in FIG. 4, the inner wall of the mandrel (16) defines upper and lower annular ring grooves (34*a*, 34*b*) having a diameter of about 4.516 inches (114.7 mm) that securely retain the upper and lower scraper rings (30*a*, 30*b*), respectively. When retained within the grooves (34*a*, 34*b*), the scraper rings (30*a*, 30*b*) will bias outwardly against the inner wall of the mandrel (16). The base pipe (10) (having an outer diameter about 4.5 inches (114 mm)) fits within close tolerance of the inner walls of the scraper rings (30*a*, 30*b*), such that the inner edges of the scraper rings (30*a*, 30*b*) may scrape against the outer wall of the base pipe (10), while still permitting the base pipe (10) to move axially within the mandrel (16) after the shearable members (20) have failed. As a non-limiting example, the scraper rings (30*a*, 30*b*) may be made of a mild strength steel alloy having metallurgical properties suitable for withstanding anticipated pressures, temperatures, and chemical conditions in an injection well.

The scraper rings (30*a*, 30*b*) may be coated with a metal phosphate coating to enhance lubricity between the scraper rings (30*a*, 30*b*) and the outer wall of the base pipe (10) to prevent damage to the base pipe (10) and its nickel alloy plating (as described above). In other embodiments, the scraper rings (30*a*, 30*b*) may have different dimensions, be secured to the mandrel (16) by different means, and be made of different materials.

Swellable Seal Elements and End Rings.

The annular swellable seal elements (36*a*, 36*b*, 36*c*) absorb a swelling fluid to increase in volume, and expand into contact with a wellbore wall, thereby sealing the annular space between the outer wall of the mandrel (16) and the wellbore wall. The seal elements (36*a*, 36*b*, 36*c*) are retained externally on the mandrel (16), either directly or indirectly. The seal elements (36*a*, 36*b*, 36*c*) are indirectly attached to the base pipe (10) via the mandrel (16) and the shearable members (20). Importantly, however, the seal elements (36*a*, 36*b*, 36*c*) are not directly attached to the base pipe (10). Accordingly, the base pipe (10) may move axially relative to the seal elements (36*a*, 36*b*, 36*c*) after the shearable members (20) have failed. In the embodiment shown in FIG. 2, the seal elements (36*a*, 36*b*, 36*c*) and the end rings (38*a*, 38*b*) are attached to each other to collectively form a Q-warp™ subassembly (Ramex AS; Norway) that slips on to the mandrel (16). This subassembly has an axial length of about 12 inches (305 mm), and a non-swelled outer diameter of about 5.850 inches (149 mm). This subassembly is suitable for use with wellbores having an inner diameter of about 6.366 inches (161.7 mm), and in applications with temperatures in the range of about 100° C. to 240° C. The upper seal element (36*a*) and the lower seal element (36*c*) may be made of an elastomer that swells when contacted with a water-based swelling fluid, while the intermediate seal element (36*b*) may be made of a hybrid elastomer that swells when contacted with either a water-based fluid or a hydrocarbon-based fluid. The end rings (38*a*, 38*b*) may be made of a metal alloy and zinc plated. The end rings (38*a*, 38*b*) define a plurality of threaded apertures (40) which permit insertion of steel set screws for securing the end rings (38*a*, 38*b*) to the mandrel (16). In other embodiments, the apparatus (100) may have only one seal element (36), or a greater number of seal elements. In other embodiments, the seal elements (36) may be adapted with different means for retaining them externally to the mandrel (16).

Response of Assembly to Thermal Expansion or Contraction.

Referring back to the SAGD system (102) of FIG. 1, the response of the assembly (100) to thermal expansion or contraction of the injection tubing string (108) is now described. The heat of steam injected into the injection tubing string (108) causes it to expand. As the uphole end of the injection tubing string (108) is substantially fixed in position, the injection tubing string (108) and the constituent base pipe (10) tend to expand in the axial downhole direction. Such expansion, however, is opposed by friction between the seal elements (36*a*, 36*b*, 36*c*) and the injection well liner (106). The seal elements (36*a*, 36*b*, 36*c*) are affixed to the mandrel (16). As a result, the base pipe (10) and the mandrel (16) apply opposing axial shear forces to the shearable members (20). When this shear force exceeds the shear strength of the shearable members (20), the shearable members (20) shear. The shear strength of the shearable members (20) may be selected so that the shearable members (20) fail before the opposing forces that act on the seal elements (36*a*, 36*c*, 36*c*) reach levels that are great enough to damage or distort the seal elements (36*a*, 36*c*, 36*c*) and compromise their seal integrity with the injection well liner (106). After the shearable members (20) have sheared, the injection tubing string (108) and its constituent base pipe (10) may move independently of the seal elements (36*a*, 36*b*, 36*c*) and the mandrel (16), which remain stationary relative to wellbore. The seal elements (36*a*, 36*b*, 36*c*) remain in sealing contact with the inner wall of the injection well liner (106). By decoupling the seal elements (36*a*, 36*b*, 36*c*) from the injection tubing string (108), the seal elements (36*a*, 36*b*, 36*c*) may be protected from damage that may otherwise occur if the seal elements (36*a*, 36*b*, 36*c*) were axially displaced by expansion or contraction of the injection tubing string (108).

The O-rings (26*a*, 26*b*) prevent fluid communication between the outer wall of the base pipe (10) and the inner wall of the mandrel (16) to maintain a pressure seal. The scraper rings (30*a*, 30*b*) shield the O-rings (26*a*, 26*b*) from debris flowing in the wellbore, and scale off of the outer wall of the base pipe (10) as it moves axially within the mandrel (16).

Exemplary Aspects.

In view of the described devices, systems, and methods and variations thereof, certain more particularly described aspects of the invention are presented below. These particularly recited aspects should not however be interpreted to have any limiting effect on any different claims containing different or more general teachings described herein, or that the "particular" aspects are somehow limited in some way other than the inherent meanings of the language literally used therein.

Aspect 1: A swellable packer assembly for use with a wellbore containing a downhole tubing string, the swellable packer assembly comprising:

(a) a tubular mandrel defining an axially extending mandrel bore;

(b) a tubular base pipe for forming part of the downhole tubing string, wherein the base pipe is disposed within the mandrel bore;

(c) an annular deformable or swellable seal element for sealing between an outer wall of the mandrel and a wall of the wellbore, wherein the seal element is retained externally on the mandrel; and (d) at least one shearable member releasably securing the base pipe to the mandrel, wherein the at least one shearable member is shearable by opposing axial shear forces applied by the base pipe and the mandrel, and wherein the base pipe is moveable axially relative to the mandrel and the at least one seal element after the at least one shearable member is sheared.

Aspect 2: The swellable packer assembly of Aspect 1, wherein the at least one shearable member comprises a shear pin extending through an aperture defined by the mandrel and into a recess defined by the base pipe.

Aspect 3: The swellable packer assembly of any one of Aspects 1 to 2, further comprising at least one O-ring seal for preventing fluid communication between an inner wall of the mandrel and an outer wall of base pipe, wherein the at least one O-ring seal is disposed within the mandrel bore, and encircles the outer wall of the base pipe.

Aspect 4: The swellable packer assembly of Aspect 3, wherein the at least one 0-ring seal is retained within at least one annular groove defined by the inner wall of the mandrel.

Aspect 5: The swellable packer assembly of any one of Aspects 1 to 2, further comprising at least one scraper ring for scraping an outer wall of the base pipe when the base pipe moves axially relative to the mandrel, wherein the at least one scraper ring is disposed within the mandrel bore, and encircles the outer wall of the base pipe.

Aspect 6: The swellable packer assembly of Aspect 5, wherein the at least one scraper ring is retained within at least one annular groove defined by an inner wall of the mandrel.

Aspect 7: The swellable packer assembly of any one of Aspects 5 to 6, wherein the at least one scraper ring comprises a pair of scraper rings, and the swellable packer assembly further comprises at least one O-ring seal for preventing fluid communication between an inner wall of the mandrel and an outer wall of base pipe, wherein the at least one O-ring seal is disposed internally within the mandrel bore, axially between the pair of scraper rings, and encircles the outer wall of the base pipe.

Aspect 8: A method for assembling a swellable packer assembly, the method comprising the steps of:

(a) attaching an annular swellable seal element externally to a tubular mandrel defining an axially extending mandrel bore;

(b) disposing a base pipe within the mandrel bore; and (c) when the base pipe is disposed within the mandrel bore, releasably securing the base pipe to the mandrel with a shearable member that is shearable by opposing axial shear forces applied by the base pipe and the mandrel, such that the base pipe is moveable axially relative to the mandrel and the seal element after the shearable member is sheared.

Aspect 9: The method of Aspect 8, wherein releasably securing the base pipe to the mandrel with the shearable member comprises extending a shear pin extending through an aperture defined by the mandrel and into a recess defined by the base pipe.

Aspect 10: The method of any one of Aspects 8 to 9, further comprising the step of disposing an O-ring seal within the mandrel bore and encircling an outer wall of the base pipe, for preventing fluid communication between an inner wall of the mandrel and the outer wall of base pipe.

Aspect 11: The method of Aspect 10, wherein the O-ring seal is retained within an annular groove defined by the inner wall of the mandrel.

Aspect 12: The method of any one of Aspects 8 to 9, further comprising the step of disposing at least one scraper ring within the mandrel bore and encircling an outer wall of the base pipe, for scraping the outer wall of the base pipe when the base pipe moves axially relative to the mandrel.

Aspect 13: The method of Aspect 12, wherein the at least one scraper ring is retained within an annular groove defined by an inner wall of the mandrel.

Aspect 14: The method of any one of Aspects 12 to 13, wherein the at least one scraper ring comprises a pair of scraper rings, and the method further comprises the step of disposing an O-ring seal within the mandrel bore axially between the pair of scraper rings, and encircling an outer wall of the base pipe, for preventing fluid communication between an inner wall of the mandrel and the outer wall of base pipe.

Aspect 15: A wellbore system comprising:

(a) a wellbore containing a downhole tubing string; and (b) a swellable packer assembly of any one of Aspects 1 to 7, wherein the base pipe of the swellable packer assembly forms part of the downhole tubing string.

Aspect 16: The wellbore system of Aspect 15, wherein the downhole tubing string comprises an injection tubing string for injecting steam into the wellbore.

Aspect 17: A method of operating a wellbore system comprising a wellbore containing a downhole tubing string, the method comprising the steps of:

(a) including a deformable or swellable packer assembly of any one of Aspects 1 to 7 in the downhole tubing string, wherein the base pipe of the swellable packer assembly forms part of the downhole tubing string;

(b) contacting the annular seal element of the swellable packer assembly with a swelling fluid, such that the seal element increases in volume to seal between the outer wall of the mandrel of the swellable packer assembly and a wall of the wellbore;

(c) allowing the at least one shearable member of the swellable packer assembly to shear due to opposing axial shear forces applied by the base pipe and the mandrel to the at least one shearable member; and (d) after the at least one shearable member is sheared, allowing axial movement of the downhole tubing string including the base pipe relative to the wellbore, while the seal element and the mandrel remain stationary relative to wellbore, with the seal element in contact with the wall of the wellbore.

Aspect 18: The method of Aspect 17, wherein thermal expansion or contraction of the downhole tubing string, opposed by friction between the seal element and the wall of the wellbore, induces the opposing axial shear forces.

Aspect 19: The method of any one of Aspects 17 to 18, wherein thermal expansion or contraction of the downhole tubing string induces the axial movement of the downhole tubing string including the base pipe relative to the wellbore.

Aspect 20: The method of any one of Aspects 17 to 19, wherein the downhole tubing string comprises an injection tubing string for injecting steam into the wellbore.

Interpretation.

The corresponding structures, materials, acts, and equivalents of all means or steps plus function elements in the claims appended to this specification are intended to include any structure, material, or act for performing the function in combination with other claimed elements as specifically claimed.

References in the specification to "one embodiment", "an embodiment", etc., indicate that the embodiment described may include a particular aspect, feature, structure, or characteristic, but not every embodiment necessarily includes that aspect, feature, structure, or characteristic. Moreover, such phrases may, but do not necessarily, refer to the same embodiment referred to in other portions of the specification. Further, when a particular aspect, feature, structure, or characteristic is described in connection with an embodiment, it is within the knowledge of one skilled in the art to affect or connect such module, aspect, feature, structure, or characteristic with other embodiments, whether or not explicitly described. In other words, any module, element or feature may be combined with any other element or feature in different embodiments, unless there is an obvious or inherent incompatibility, or it is specifically excluded.

It is further noted that the claims may be drafted to exclude any optional element. As such, this statement is intended to serve as antecedent basis for the use of exclusive terminology, such as "solely," "only," and the like, in connection with the recitation of claim elements or use of a "negative" limitation. The terms "preferably," "preferred," "prefer," "optionally," "may," and similar terms are used to indicate that an item, condition or step being referred to is an optional (not required) feature of the invention.

The singular forms "a," "an," and "the" include the plural reference unless the context clearly dictates otherwise. The term "and/or" means any one of the items, any combination of the items, or all of the items with which this term is associated. The phrase "one or more" is readily understood by one of skill in the art, particularly when read in context of its usage.

The term "about" can refer to a variation of ±5%, ±10%, ±20%, or ±25% of the value specified. For example, "about 50" percent can in some embodiments carry a variation from 45 to 55 percent. For integer ranges, the term "about" can include one or two integers greater than and/or less than a recited integer at each end of the range. Unless indicated otherwise herein, the term "about" is intended to include values and ranges proximate to the recited range that are equivalent in terms of the functionality of the composition, or the embodiment.

As will be understood by one skilled in the art, for any and all purposes, particularly in terms of providing a written description, all ranges recited herein also encompass any and all possible sub-ranges and combinations of sub-ranges thereof, as well as the individual values making up the range, particularly integer values. A recited range includes each specific value, integer, decimal, or identity within the range. Any listed range can be easily recognized as sufficiently describing and enabling the same range being broken down into at least equal halves, thirds, quarters, fifths, or tenths. As a non-limiting example, each range discussed herein can be readily broken down into a lower third, middle third and upper third, etc.

As will also be understood by one skilled in the art, all language such as "up to", "at least", "greater than", "less than", "more than", "or more", and the like, include the number recited and such terms refer to ranges that can be subsequently broken down into sub-ranges as discussed above. In the same manner, all ratios recited herein also include all sub-ratios falling within the broader ratio.

The claimed invention is:

1. A swellable packer assembly for use with a wellbore containing a downhole tubing string, the swellable packer assembly comprising:

a. a tubular mandrel defining an axially extending mandrel bore;

b. a tubular base pipe for forming part of the downhole tubing string, wherein the base pipe is disposed within the mandrel bore;

c. an annular swellable seal element for sealing between an outer wall of the mandrel and a wall of the wellbore, wherein the seal element is retained externally on the mandrel;

d. at least one shearable member releasably securing the base pipe to the mandrel, wherein the at least one shearable member is shearable by opposing axial shear forces applied by the base pipe and the mandrel, and wherein the base pipe is moveable axially relative to the mandrel and the at least one seal element after the at least one shearable member is sheared;

e. a pair of scraper rings for scraping an outer wall of the base pipe when the base pipe moves axially relative to the mandrel, wherein the pair of scraper rings are disposed within the mandrel bore, and encircles the outer wall of the base pipe; and f. at least one O-ring seal for preventing fluid communication between an inner wall of the mandrel and an outer wall of base pipe, wherein the at least one O-ring seal is disposed internally within the mandrel bore, axially between the pair of scraper rings, and encircles the outer wall of the base pipe.

2. The swellable packer assembly of claim 1, wherein the at least one shearable member comprises a shear pin extending through an aperture defined by the mandrel and into a recess defined by the base pipe.

3. The swellable packer assembly of claim 1, further comprising at least one O-ring seal for preventing fluid communication between an inner wall of the mandrel and an outer wall of base pipe, wherein the at least one O-ring seal is disposed within the mandrel bore, and encircles the outer wall of the base pipe.

4. The swellable packer assembly of claim 3, wherein the at least one O-ring seal is retained within at least one annular groove defined by the inner wall of the mandrel.

5. The swellable packer assembly of claim 1, wherein the at least one scraper ring is retained within at least one annular groove defined by an inner wall of the mandrel.

6. A method of operating a wellbore system comprising a wellbore containing a downhole tubing string, the method comprising the steps of:

a. including the swellable packer assembly of claim 1 in the downhole tubing string, wherein the base pipe of the swellable packer assembly forms part of the downhole tubing string;

b. contacting the annular seal element of the swellable packer assembly with a swelling fluid, such that the seal element increases in volume to seal between the outer wall of the mandrel of the swellable packer assembly and a wall of the wellbore;

c. allowing the at least one shearable member of the swellable packer assembly to shear due to opposing axial shear forces applied by the base pipe and the mandrel to the at least one shearable member; and d. after the at least one shearable member is sheared, allowing axial movement of the downhole tubing string including the base pipe relative to the wellbore, while the seal element and the mandrel remain stationary relative to wellbore, with the seal element in contact with the wall of the wellbore.

7. The method of claim 6, wherein thermal expansion or contraction of the downhole tubing string, opposed by friction between the seal element and the wall of the wellbore, induces the opposing axial shear forces.

8. The method of claim 6, wherein thermal expansion or contraction of the downhole tubing string induces the axial movement of the downhole tubing string including the base pipe relative to the wellbore.

9. The method of claim 6, wherein the downhole tubing string comprises an injection tubing string for injecting steam into the wellbore.

* * * * *